United States Patent [19]

Chen

[11] Patent Number: 4,748,878

[45] Date of Patent: Jun. 7, 1988

[54] IMPACT SOCKET WRENCH OR AN ATTACHMENT ASSEMBLY WITH HAMMERING EFFECT

[76] Inventor: Lu-I Chen, 35 Chen Hsing Rd., Chaochou, Pingtung, Taiwan

[21] Appl. No.: 33,465

[22] Filed: Apr. 2, 1987

[51] Int. Cl.[4] ..... B25B 19/00

[52] U.S. Cl. ..... 81/466; 29/275

[58] Field of Search ..... 81/119, 463, 464, 465, 81/466; 29/275

[56] References Cited

U.S. PATENT DOCUMENTS

| | | | |
|---|---|---|---|
| 3,158,050 | 3/1963 | Shandel | 81/466 |
| 4,455,899 | 6/1984 | Savell | 81/466 |
| 4,628,776 | 12/1986 | Witbeck | 81/466 |

*Primary Examiner*—Frederick R. Schmidt
*Assistant Examiner*—Lawrence Cruz
*Attorney, Agent, or Firm*—Wenderoth, Lind & Ponack

[57] ABSTRACT

An impact socket wrench provides a hammering space for generating a hammering or striking effect. The hammering space is alternatively provided by an attachment assembly fitted between a conventional wrench handle and socket head of a conventional socket wrench. The attachment assembly comprises an upper adapter and a lower adapter for mounting on a conventional socket wrench. When screwing or unscrewing a screw or the like, the hammering space of the socket wrench or attachment assembly allows the generation of a hammering or striking force without using an external force or tool such as a hammer of the like to hit the wrench handle. Both the socket wrench and attachment assembly achieve the hammering affect by utilizing a substantially diamond-shaped head pinned between the socket wrench handle and the socket head. The diamond-shaped head allows relative movement between the handle and the socket for generating hammering forces.

5 Claims, 4 Drawing Sheets

IMPACT SOCKET WRENCH OR AN ATTACHMENT ASSEMBLY WITH HAMMERING EFFECT

BACKGROUND OF THE INVENTION

A socket wrench is a conventional tool for screwing or unscrewing a screw or a nut. A socket wrench usually comprises a wrench handle and a set of socket heads of different sizes. One end of the wrench handle is pivotally mounted with a square head that can be turned freely at a given angle. The top of the socket head has a square hole for receiving the square head on the wrench handle, while the lower hole is fitted over a nut or screw head. A wrench handle is usually furnished with a number of socket heads of different sizes so as to fit screws of various sizes.

When using a conventional socket wrench, the socket head and the screw bolt are closely fitted to each other, and the square head on the wrench handle and the socket head are also fitted closely. Upon unscrewing a screw bolt that has been screwed very tight, or has been rusted because of being fixed in place for a long time, the conventional socket wrench handle has to be hit to turn it by using a hammer so as to obtain more hammering and turning force to loosen the screw bolt or nut. Likewise, when a screw bolt has to be screwed tightly with a conventional socket wrench, the handle of the wrench also has to be hit with a hammer in the last stage of turning the wrench. The requirement of hitting the conventional socket wrench handle is considered a drawback of the conventional socket wrench; further, the action of hitting the wrench handle with a hammer is hazardous.

In view of the aforesaid drawbacks of the conventional socket wrench, the inventor has developed this invention to improve the conventional socket wrench; i.e., the socket wrench according to the present invention has a built-in member to provide a hammering effect without using an external tool or force. This invention also provides an attachment assembly, which can be mounted on a conventional socket wrench to generate a hammering effect.

U.S. Pat. No. 1,722,652 to M. T. Archer discloses a wrench, which can provide a hammering or striking force, but it is considered different from the present invention. In Archer's disclosure, the handle and the jaw of the wrench are formed as one piece, a considerable big head portion, which takes a lot of space during working over a screw bolt or nut.

The socket wrench according to the present invention has a small head, movable at a given angle, and takes a very small space during operating over a screw bolt; therefore, it is different in structure from the aforesaid wrench.

U.S. Pat. No. 1,787,185 to L. D. Baird discloses a wrench, which is used for setting up and disconnecting the couplings that connect the adjoining sections of a string of sucker rods used in pumping oil wells. It is quite different in structure and use from the wrench of the present invention.

U.S. Pat. No. 3,157,074 to L. M. Durkee discloses hand operated impact wrench, of which the structure is different from that of the present invention aside from the large dimension thereof. Between the crank to exert force and the screw bolt to receive the impact force, there is a longer distance. The hammer arms and the hammer heads have formed a big disc portion over the screw bolt to be operated on; its gravity center must be unstable during operating, and therefore, it is deemd not an ideal and workable tool.

U.S. Pat. No. 3,366,187 to A. L. Von Tersch discloses an impact driver, which has to be hit on its head portion which a hammer, but the present invention is to eliminate or improves upon the use of such an external hammer. The structure of the Von Tersch impact driver is rather complicated, and the impact force is applied axially. the object of the present invention is improve the conventional socket wrench, or is to add an attachment assembly to a conventional socket wrench, both of which utilize nonaxially applied forces; therefore, the way of using the Von Tersch driver and the wrench according to the present invention is quite different.

SUMMARY OF THE INVENTION

The prime object of the present invention is to improve the conventional socket wrench by adding a built-in striking or hammering space in the socket wrench so as to generate a striking or hammering effect; i.e., when unscrewing a tight screw bolt or screwing a screw bolt, no external tool, such as a hammer is required to hit the rear end of the wrench handle. The aforesaid conventional socket wrench comprises a wrench handle and a set of socket heads of different sizes; the wrench head is mounted with a square head that can be turned at a given angle.

Another object of the present invention is to add an attachment assembly to the conventional socket wrench without changing the structure of that conventional socket wrench but obtaining the desired hammering effect.

DETAILED DESCRIPTION

Figure 6:
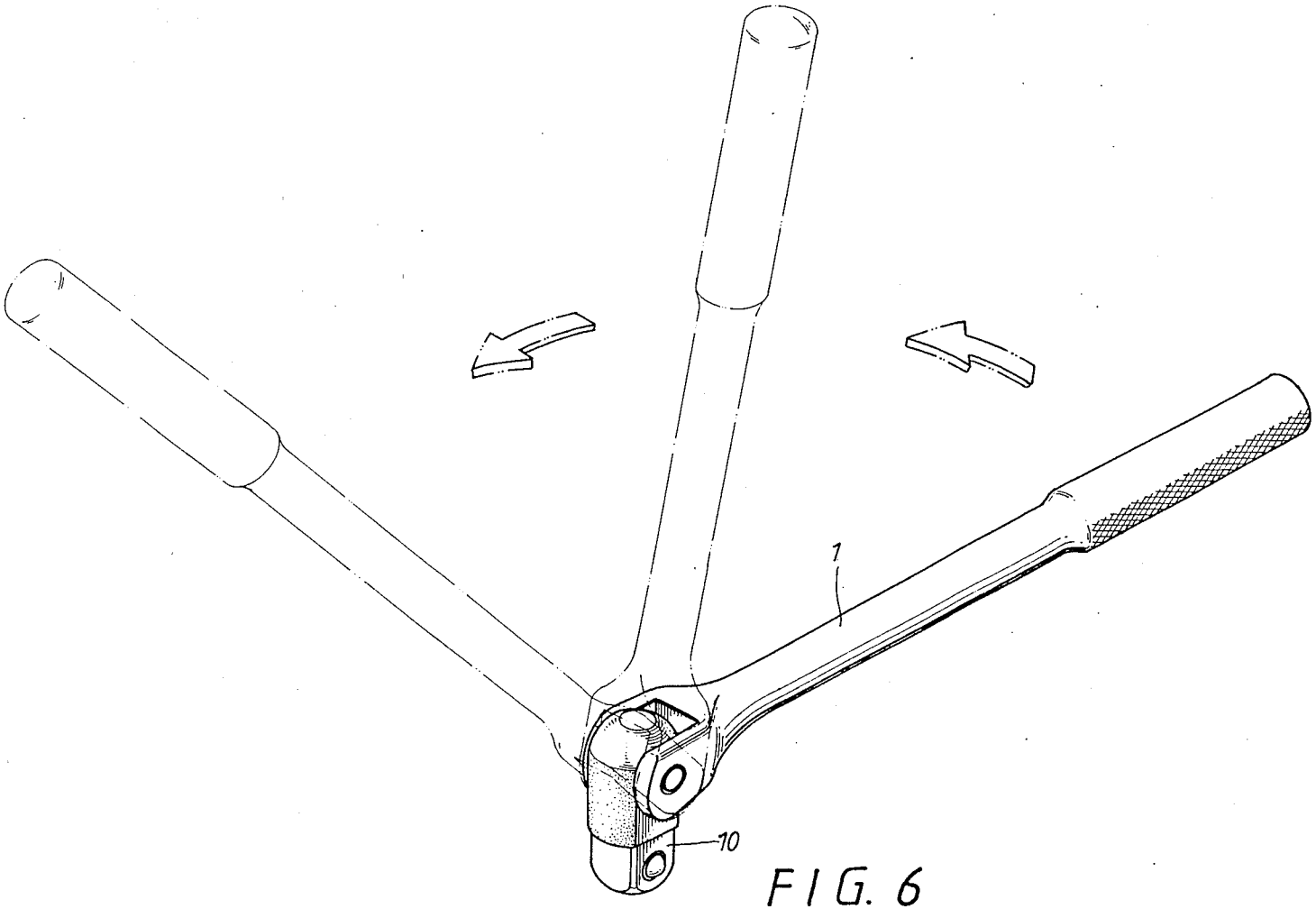
FIG. 6 is a perspective view of the prior art socket wrench handle referred to in discussing this invention.

FIG. 6 illustrates the wrench handle of a conventional socket wrench; the wrench handle 1 has a square head 10, which is pivotally mounted between the jaws at one end of the wrench handle. The present invention is an improvement of the aforesaid conventional socket wrench as shown in the first embodiment of the present invention; the second embodiment of the present invention is an attachment assembly, which is used together with the conventional socket wrench.

Figure 1:
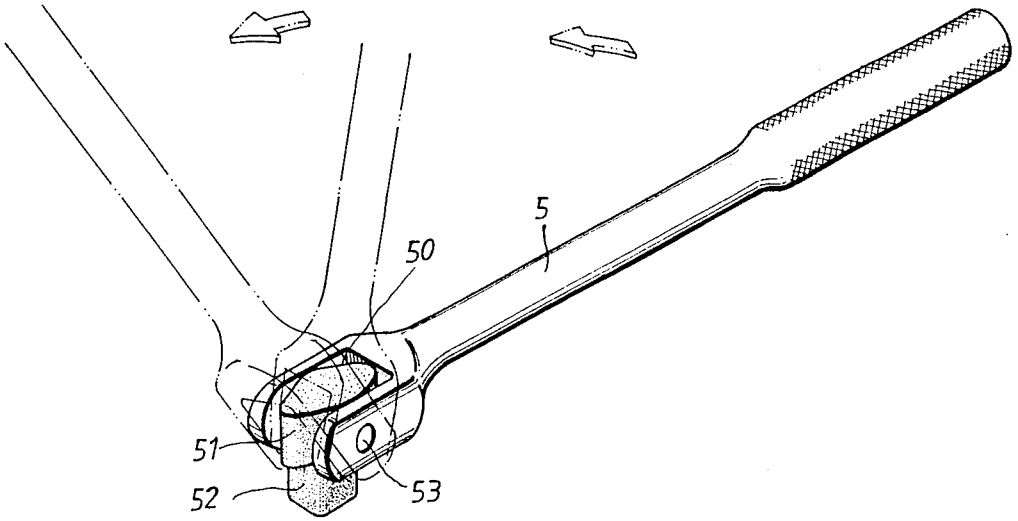
FIG. 1 is a perspective view of the wrench handle in the first embodiment of the present invention.
Figure 2:
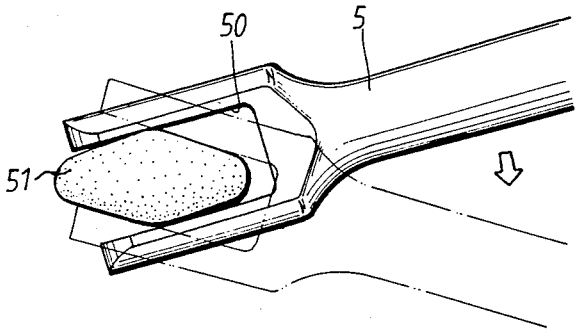
FIG. 2 is a top view of the wrench handle shown in FIG. 1, showing the hammering or impact operation thereof.
Figure 3:
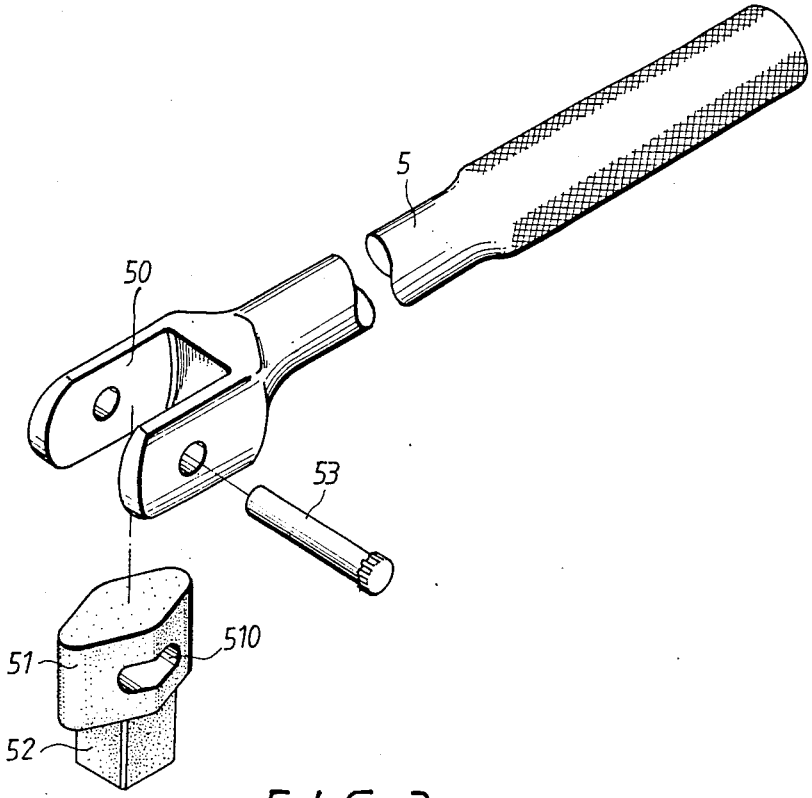
FIG. 3 is a disassembled view of the wrench handle shown in FIG. 1.
Figures 4, 5:
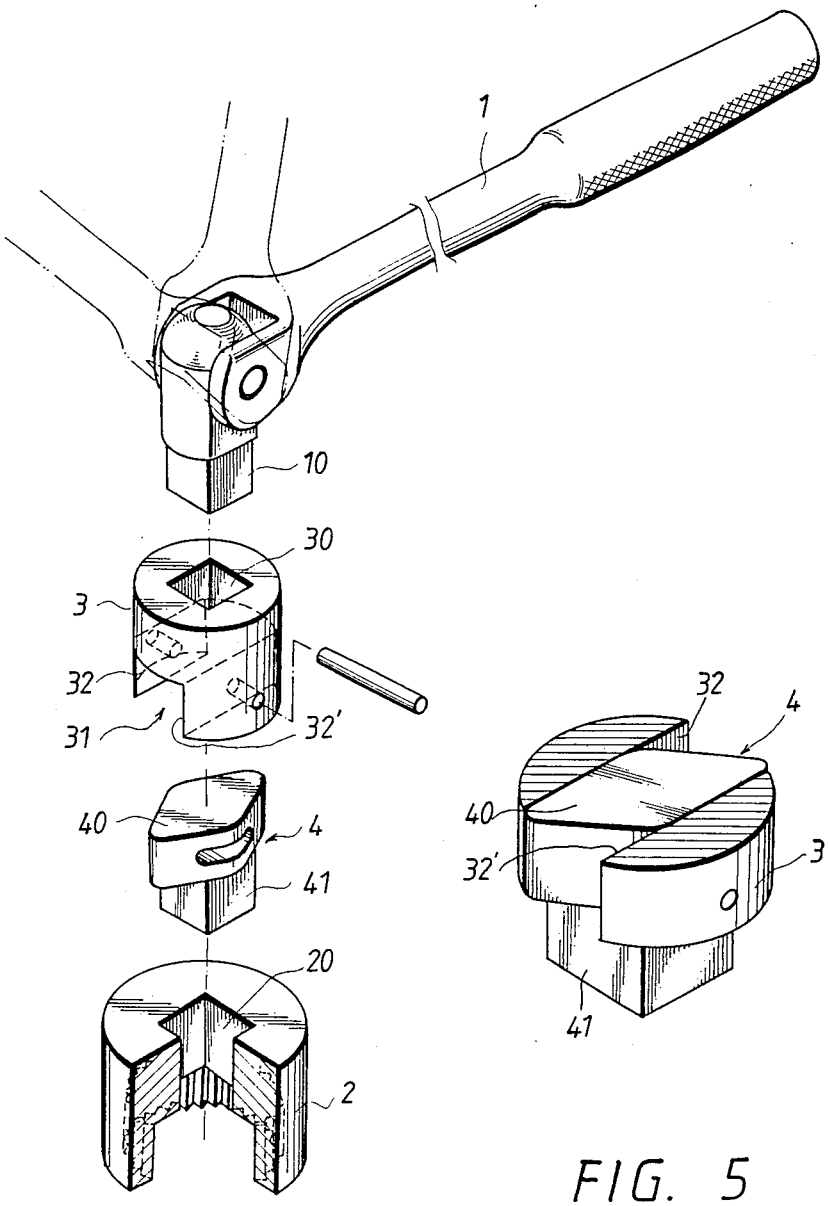
FIG. 4 is the second embodiment of the present invention, which is a hammering attachment assembly to be used together with a conventional socket wrench.
FIG. 5 illustrates the or impact attachment assembly being operated with the hammering effect.

The first embodiment of the present invention as shown in FIGS. 1, 2 and 3 is a socket wrench with a hammering or impact effect in operation, in which the wrench head mounted in the square opening 50 includes two parts, i.e., an upper portion 51 and a lower portion 52. The lower portion 52 is to be fitted in the socket of a conventional socket wrench (as shown in FIG. 4, the socket head 2), and it has the same form as the square head 10 of the conventional wrench handle 1. The upper portion 51 is a formed approximately into a diamond shape. The opposite angles of the upper (lozenge) portion 51 have become somewhat curved shaped respectively. The width between the two obtuse opposite angles is smaller than the width of the square opening 50 so as to let the lozenge-shaped portion 51 fit in the square opening 50. The lozenge portion 51 has a lateral hole 510 for receiving a fixing or pivot pin 53 so as to have the wrench head pivotally mounted in the square opening 50 and moved laterally and longitudinally.

According to the present invention, the two obtuse angles of the lozenge portion 51 and the two walls of the square opening 50 form a hammering space; upon turning the wrench rod 5 back and forth, the wall surface of the square opening 50 hammers the side part of the lozenge portion 51 to generate a hammering effect.

According to the aforesaid principle, a similar attachment assembly may also be fitted to a conventional socket wrench to provide the same hammering effect. This is as shown in the second embodiment of the present invention.

FIGS. 4 and 5 illustrate the second embodiment of the present invention, which is an attachment to be fitted between the wrench handle 1 of a conventional socket wrench and its socket head 2. The attachment assembly of the second embodiment comprises an upper adapter 3 and a lower adapter 4. The top of the upper adapter 3 is furnished with a square hole 30 for receiving the square head 10 of the conventional socket wrench. The lower part 41 of the lower adapter 4 has a square part, which is the same as the square head 10 on the conventional wrench handle 1, for fitting into the hole 20 of the socket head 2 of a conventional socket wrench as shown in FIG. 4.

After the upper and lower adaptors 3 and 4 are fitted together, a hammering space is maintained between them because of the two obtuse opposite angles of the diamond-shaped head 40 of the lower adaptor 4 being formed almost into a round surface to be fitted between the two vertical inner walls 32 and 32′ of the rectangular channel 31; the width of the rectangular channel 31 is slightly wider than that of the diamond-shaped head 40 of the lower adaptor 4 so as to have the head 40 fitted in the channel 31. Upon the upper 3 being fitted over the lower adaptor 4, the two acute opposite angles of the diamond-shaped head 40 will have a hammering space with the two vertical inner walls 32 and 32′.

Therefore, when using a socket wrench fitted with the upper and lower adaptors to unscrew a screw, the user may just turn the wrench handle 1 back and forth horizontally; the two vertical inner walls 32 and 32′ repeatedly hit the sides of the diamond-shaped head 40 until the screw is loosened. For a screw to be tightened, the user turns the wrench handle 1 back and forth repeatedly at the latter screwing stage so as to let the upper adaptor 3 hit the lower adaptor 4 repeatedly for providing a hammering force.

I claim:

1. An impact wrench comprising:

a wrench handle having opposite ends;

an opening at one end of said wrench handle, said opening having at least two spaced opposed substantially vertical sides supporting a fixing pin means therebetween and for holding a wrench head therein, a wrench head pivotably attached in said opening by said fixing pin means;

said wrench head including an upper and lower portion;

said upper portion having at least two pairs of substantially parallel mutually-angled vertical faces for contacting said spaced opposed sides of the opening of the socket wrench, one face of each pair of said at least two pairs of mutually-angled faces contacting the sides of the opening concurrently, and when the respective one face of each pair of said at least two pairs of adjacent faces contacts the respective side of the opening, the other face of each pair of said at least two pairs of faces is spaced from and angled from the respective side of the opening, said upper portion being pivotaly about a substantially vertical axis for contacting each respective face of each pair of said at least two pairs of vertical adjacent faces against the spaced opposed sides of the opening of the socket wrench in turn; and said lower portion being attached to said upper portion, and having means for releasably retaining a socket head.

2. A wrench head structure as in claim 1, wherein said upper portion is substantially diamond-shaped.

3. An attachment assembly for attaching a wrench head of a socket wrench to a socket head, said attachment assembly comprising:

an upper adaptor having an upper portion with means for releasably attaching a wrench head thereto, a lower portion having a channel with substantially vertical spaced opposed sides, and a fixing pin means for pivotably support a lower adaptor;

a lower adaptor having an upper portion received in said channel of said upper adaptor, a lower portion with means for releasably attaching a socket head thereto, and said upper portion of said lower adaptor having at least two pairs of substantially mutually-angled adjacent faces for contacting said spaced opposed sides of said channel, one face of each pair of said at least two pairs of mutually-angled faces contacting said sides of said channel concurrently, and when the respective one face of each pair of said at least two pairs of adjacent faces contacts the respective side of said channel, the other face of each pair of said at least two pairs of faces is spaced from and angled from the respective side of said channel, said lower adaptor being pivotable about a substantially vertical axis for contacting each respective face of each pair of said at least two pairs of vertical adjacent faces against said spaced opposed sides of said channel in turn.

4. An attachment assembly as in claim 3, wherein said upper portion of said lower adaptor is substantially diamond-shaped.

5. An attachment assembly as in claim 3, wherein said fixing pin means is substantially horizontal and said lower adaptor is rotatably thereabout.

* * * * *